US008494843B2

(12) United States Patent
Sung et al.

(10) Patent No.: US 8,494,843 B2
(45) Date of Patent: Jul. 23, 2013

(54) ENCODING AND DECODING APPARATUSES FOR IMPROVING SOUND QUALITY OF G.711 CODEC

(75) Inventors: Jong Mo Sung, Daejeon (KR); Hyun Joo Bae, Daejeon (KR); Byung Sun Lee, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 853 days.

(21) Appl. No.: 12/640,745

(22) Filed: Dec. 17, 2009

(65) Prior Publication Data

US 2010/0161322 A1 Jun. 24, 2010

(30) Foreign Application Priority Data

Dec. 19, 2008 (KR) ..... 10-2008-0130476

(51) Int. Cl.
*G10L 19/14* (2006.01)

(52) U.S. Cl.
USPC ..... 704/205; 704/229; 704/230

(58) Field of Classification Search
USPC ..... 704/200, 227, 228, 200.1, 500–504, 704/229, 205, 230
See application file for complete search history.

(56) References Cited

U.S. PATENT DOCUMENTS 5,664,056 A * 9/1997 Akagiri ..... 704/200.1
2009/0070107 A1 * 3/2009 Kawashima et al. ..... 704/229

FOREIGN PATENT DOCUMENTS

KR 1020040050811 A 6/2004
KR 1020040073589 A 8/2004
KR 1020090017996 A 2/2009

OTHER PUBLICATIONS

S.D.Zhang, et al; "An Efficient Embedded ADPCM Coder", Telecommunications, Mar. 26-29, 1995, Conference Publication No. 404, pp. 210-214.

Yusuke Hiwasaki, et al; "G.711.1: A Wideband Extension to ITU-T G.711", 16th European Signal Processing Conference (EUSIPCO 2008), Lausanne, Switzerland, Aug. 25-29, 2008, copyright by EURASIP (5 pages).

N.S. Jayant; "Variable Rate ADPCM Coding of Speech Based on Explicit Noise Coding", IEEE 1983 (exact date not given), pp. 188-192.

* cited by examiner

*Primary Examiner* — Huyen X. Vo
(74) *Attorney, Agent, or Firm* — Ladas & Parry LLP

(57) ABSTRACT

An encoding apparatus and a decoding apparatus for reducing the quantization error of a G.711 codec and improving sound quality are provided. The encoding apparatus includes a G.711 encoder which generates a G.711 bitstream by encoding an input audio signal; an enhancement-layer encoder which chooses one of a static bit allocation method and a dynamic bit allocation method that can produce less quantization error based on the input audio signal and the G.711 bitstream, and outputs an enhancement-layer bitstream including encoded additional mantissa information obtained by using the chosen bit allocation method; and a multiplexer which multiplexes the G.711 bitstream and the enhancement-layer bitstream. Therefore, it is possible to reduce the quantization error of a G.711 codec and improve sound quality.

20 Claims, 8 Drawing Sheets

FIG. 5A

| EXPONENT INDEXES \ SAMPLE INDEXES | 0 | 1 | 2 | 3 | .... | 39 |
|---|---|---|---|---|---|---|
| 0 | | | | | | |
| 1 | | | | | | |
| 2 | | | | | | |
| 3 | | | 2 | | | |
| 4 | | 1 | 2 | | | |
| 5 | | 1 | 2 | | .... | |
| 6 | 0 | 1 | | | | 39 |
| 7 | 0 | | | | | 39 |
| 8 | 0 | | | | | 39 |
| 9 | | | | | | |

FIG. 5B

| EXPONENT INDEXES \ SEQUENCE INDEXES | 0 | 1 | 2 | 3 | .... | 39 |
|---|---|---|---|---|---|---|
| 0 | 3 | | | | | |
| 1 | 3 | | | | | |
| 2 | 3 | | | | | |
| 3 | 2 | 4 | | | | |
| 4 | 1 | 2 | 4 | | | |
| 5 | 1 | 2 | 4 | | .... | |
| 6 | 0 | 1 | | | | 39 |
| 7 | 0 | | | | | 39 |
| 8 | 0 | | | | | 39 |
| 9 | | | | | | |

SAMPLE INDEXES

ENCODING AND DECODING APPARATUSES FOR IMPROVING SOUND QUALITY OF G.711 CODEC

CROSS-REFERENCE TO RELATED APPLICATION

This application claims priority from Korean Patent Application No. 10-2008-0130476, filed on Dec. 19, 2008 in the Korean Intellectual Property Office, the disclosure of which is incorporated herein by reference in its entirety.

BACKGROUND OF THE INVENTION

1. Field of the Invention

The present invention relates to encoding and decoding apparatuses, and more particularly, to encoding and decoding apparatuses for reducing the quantization error of a G.711 codec and improving sound quality.

2. Description of the Related Art

In general, it is difficult to directly apply techniques for digitalizing analog audio data simply through sampling to various fields of application with a relatively narrow bandwidth. For example, if an audio signal is sampled at a frequency of 8 kHz and is quantized with 16 bits, a bitrate of 128000 bps may be obtained. Most audio 06FEEL014US04communication networks adopt a codec apparatus for compressing and restoring audio signals in order to effectively transmit audio signals at low bitrate.

There are various methods of compressing and restoring audio signals such as pulse code modulation (PCM) or code-excited linear prediction (CELP). PCM is characterized by compressing audio samples with a predefined number of bits per sample, and CELP is characterized by processing audio data in units of blocks and compressing the audio data using a speech production model. Various types of codecs have been developed and standardized for use in various fields of application. In particular, logarithmic PCM codecs, which are one of the most widespread codecs and generally used in the fields of public switched telephone network (PSTN) wired telecommunication and Internet telecommunication, may vary a quantization level according to the size of an input signal. That is, logarithmic PCM codecs may use a low quantization level for a low-level input signal and a high quantization level for a high-level input signal. By using a logarithmic PCM codec, it is possible to compress a 16-bit digital sample into an 8-bit sample. Therefore, a bitrate of 64,000 bps may be obtained by performing sampling at a frequency of 8 KHz using logarithmic PCM. There are largely two logarithmic quantization algorithms: the μ-law algorithm and the A-law algorithm. The μlaw algorithm and the A-law algorithm may be defined by Equations (1):

$$C_\mu(|x|) = \frac{\log_{10}(1+\mu|x|)}{\log_{10}(1+\mu)} \tag{1}$$

$$C_A(|x|) = \begin{cases} \dfrac{\log_{10}(A|x|)}{\log_{10}(A)} & \text{for } |x| > \dfrac{1}{A} \\ \dfrac{A|x|}{1+\log_{10}(A)} & \text{for } |x| \le \dfrac{1}{A} \end{cases}$$

where x indicates an input sample, μ and A are constants corresponding to the μ-law algorithm and the A-law algorithm, C( ) indicates a compressed sample obtained using the μ-law algorithm or the A-law algorithm, and |x| indicates the absolute value of the input sample x.

The μ-law algorithm and the A-law algorithm were standardized as G711 in 1972 by the International Telecommunication Union Telecommunication Sector (ITU-T). Referring to Equations (1), the constants μ and A are 255 and 87.56, respectively. In reality, G.711 codecs generally use floating point quantization, instead of performing computation, as indicated by Equations (1). Some of the available bits (for example, 8 bits in the case of G.711) of each sample may be used to determine a quantization level, and the other available bits may be used to represent position in the quantization level. The available bits used to determine a quantization level are referred to as exponent bits, and the available bits used to determine position in a quantization level are referred to as mantissa bits. In the A-law algorithm, three bits of each 8-bit sample are used to represent exponent information, four bits to represent mantissa information, and one bit to represent the sign of a corresponding sample.

G.711 codecs can provide excellent sound quality rated a mean opinion score (MOS) of at least 4 for narrow-band audio data sampled at a frequency of 8 KHz, and requires only minimal amounts of computation and storage. However, G.711 codecs may still suffer from poor sound quality due to quantization error.

SUMMARY OF THE INVENTION

The present invention provides encoding and decoding apparatuses for reducing the quantization error of a G.711 codec and improving sound quality.

According to an aspect of the present invention, there is provided an encoding apparatus including a G.711 encoder which generates a G.711 bitstream by encoding an input audio signal; an enhancement-layer encoder which chooses one of a static bit allocation method and a dynamic bit allocation method that can produce less quantization error based on the input audio signal and the G.711 bitstream and outputs an enhancement-layer bitstream including encoded additional mantissa information obtained by using the chosen bit allocation method; and a multiplexer which multiplexes the G.711 bitstream and the enhancement-layer bitstream.

According to another aspect of the present invention, there is provided a decoding apparatus including a demultiplexer which demultiplexes an input bitstream into a G.711 bitstream and an enhancement-layer bitstream; a G.711 decoder which generates a decoded G.711 signal by decoding the G.711 bitstream; an enhancement-layer decoder which generates a decoded enhancement-layer signal by decoding encoded additional mantissa information obtained using a method determined by a mode flag included in the enhancement-layer bitstream; and a signal synthesizer which synthesizes the decoded G.711 signal and the decoded enhancement-layer signal.

BRIEF DESCRIPTION OF THE DRAWINGS

The above and other features and advantages of the present invention will become more apparent by describing in detail preferred embodiments thereof with reference to the attached drawings in which:

FIGS. 5A and 5B illustrate diagrams of examples of an exponent map of a dynamic bit allocator shown in FIG. 4;

DETAILED DESCRIPTION OF THE INVENTION

The present invention will hereinafter be described in detail with reference to the accompanying drawings in which exemplary embodiments of the invention are shown.

Figure 1:
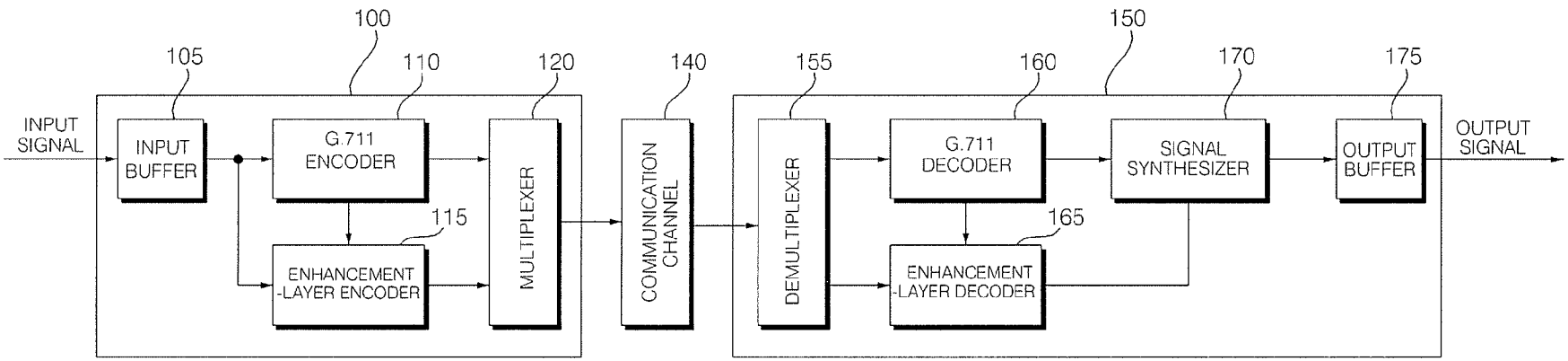
FIG. 1 illustrates a block diagram of encoding and decoding apparatuses for improving the sound quality of a G.711 codec, according to exemplary embodiments of the present invention.

FIG. 1 illustrates a block diagram of encoding and decoding apparatuses 100 and 150 for improving the sound quality of a G.711 codec, according to exemplary embodiments of the present invention. Referring to FIG. 1, the encoding apparatus 100 may include an input buffer 105, a G.711 encoder 110, an enhancement-layer encoder 115 and a multiplexer 120.

The decoding apparatus 150 may include a demultiplexer 155, a G.711 decoder 160, an enhancement-layer decoder 165, a signal synthesizer 170 and an output buffer 175.

The encoding apparatus 100 and the decoding apparatus 150 may be connected to each other by a communication channel 140.

The encoding apparatus 100 will hereinafter be described in detail.

The input buffer 105 may store an input signal in units of frames and may thus enable the input signal to be processed in units of the frames. For example, in order to process the input signal at a sampling rate of 8 KHz at intervals of 5 ms, the input buffer 105 may store the input signal in units of frames each having 40 samples (=8 KHz*5 ms).

The G.711 encoder 110 may generate a bitstream by encoding the frames present in the input buffer 105 using a typical G.711 codec, and may output the generated bitstream. The G.711 codec is an ITU-T standard codec, and is well-known to one of ordinary skill in the art to which the present invention pertains. Thus, a detailed description of the G.711 codec will be omitted.

The enhancement-layer encoder 115 may quantize quantization error that cannot be properly represented by the G.711 encoder 110 using a number of additionally-allocated bits.

More specifically, the enhancement-layer encoder 115 may choose whichever of a static bit allocation method and a dynamic bit allocation method is optimal for processing the input signal, and may encode additional mantissa information using the chosen bit allocation method. Therefore, it is possible to considerably reduce quantization error and thus to improve sound quality. The structure and operation of the enhancement-layer encoder 115 will be described later in further detail with reference to FIGS. 4 through 8.

The multiplexer 120 may multiplex a G.711 bitstream output by the G.711 encoder 110 and an enhancement-layer bitstream output by the enhancement-layer encoder 115, and may transmit a bitstream obtained by the multiplexing to the decoding apparatus 150 through the communication channel 140.

The decoding apparatus 150 will hereinafter be described in detail.

The demultiplexer 155 may demultiplex a bitstream provided by the encoding apparatus 100 into a G.711 bitstream and an enhancement-layer bitstream.

The G.711 decoder 160 may decode the G.711 bitstream provided by the demultiplexer 155 using a G.711 codec.

The enhancement-layer decoder 165 may decode the enhancement layer provided by the demultiplexer 155 using a reverse method to the method used by the enhancement-layer encoder 115.

More specifically, the enhancement-layer decoder 165 may choose whichever of a static bit allocation method and a dynamic bit allocation method is optimal for decoding the enhancement-layer bitstream provided by the demultiplexer 155, and may decode additional mantissa information using the chosen bit allocation method. Therefore, it is possible to considerably reduce quantization error and thus to improve sound quality. The structure and operation of the enhancement-layer decoder 165 will be described later in further detail with reference to FIGS. 4 through 8.

The signal synthesizer 170 may synthesize a decoded G.711 signal provided by the G.711 decoder 160 and a decoded enhancement-layer signal provided by the enhancement-layer decoder 165.

The output buffer 175 may store a decoded signal provided by the signal synthesizer 170 and may output the decoded signal in units of frames.

Figure 2:
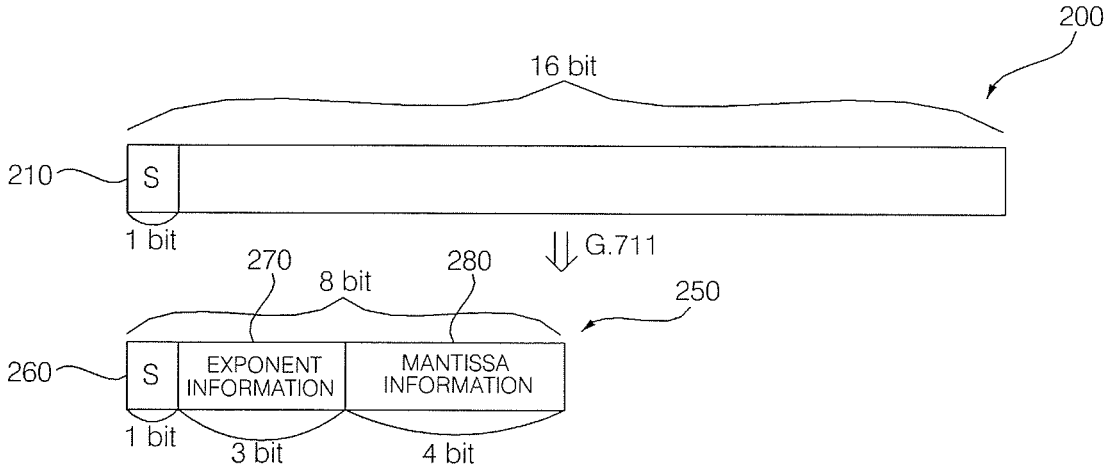
FIG. 2 illustrates diagrams of a bitstream input to a G.711 encoder shown in FIG. 1 and a bitstream output from the G.711 encoder.
Figure 3:
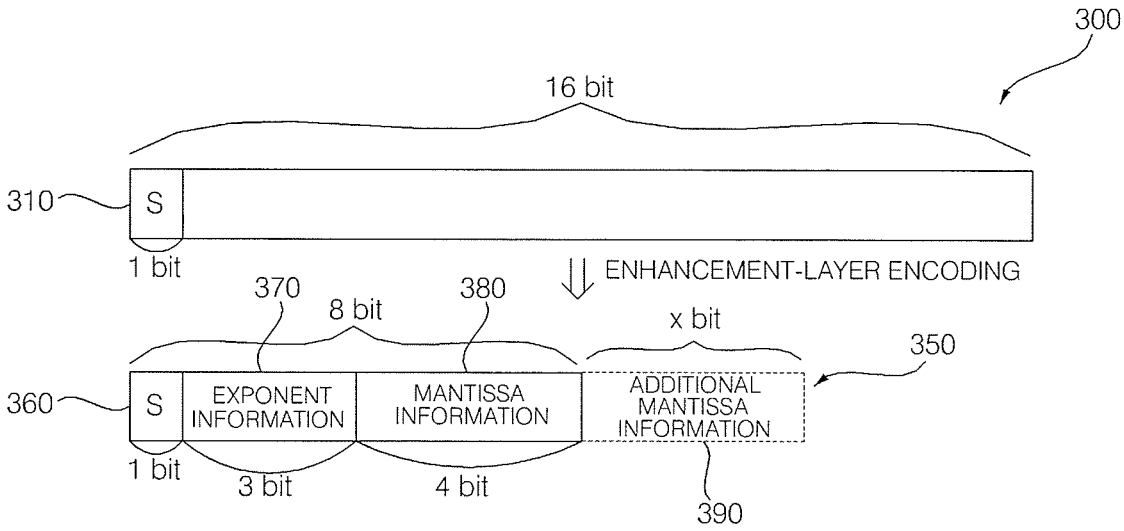
FIG. 3 illustrates diagrams of a bitstream input to an enhancement-layer encoder shown in FIG. 1 and a bitstream output from the enhancement-layer encoder.

FIG. 2 illustrates a diagram of a bitstream input to the G.711 encoder 110 and a bitstream output from the G.711 encoder 110, and FIG. 3 illustrates a diagram of a bitstream input to the enhancement-layer encoder 115 and a bitstream output from the enhancement-layer encoder 115.

Referring to FIG. 2, the G.711 encoder 110 may receive a 16-bit sample 200, may compress the 16-bit sample 200 into an 8-bit sample 250, and may output the 8-bit sample 250. The 8-bit sample 250 may include sign information 260, which is one bit long, exponent information 270, which is three bits long, and mantissa information 280, which is four bits long. The exponent information 270 may indicate a compander segment, and the mantissa information 280 may indicate a position in the compander segment indicated by the exponent information 270.

Referring to FIG. 3, the combination of the G.711 encoder 110 and the enhancement-layer encoder 115 may receive a 16-bit sample 300, may compress the 16-bit sample 300 into a sample 350 including sign information 360, which is one bit long, exponent information 370, which is three bits long, mantissa information 380, which is four bits long, and additional mantissa information 390, which is x bits long.

The additional mantissa information 390 may specify position information indicated by the mantissa information 380 more precisely and may thus reduce the quantization error of a G.711 codec.

In exemplary embodiments of the present invention, the additional mantissa information 390 may be encoded or decoded using whichever of a dynamic bit allocation method and a static bit allocation method is optimal. Thus, it is possible to considerably reduce quantization error and thus to improve sound quality. This will hereinafter be described in further detail with reference to FIGS. 4 through 8.

Figure 4:
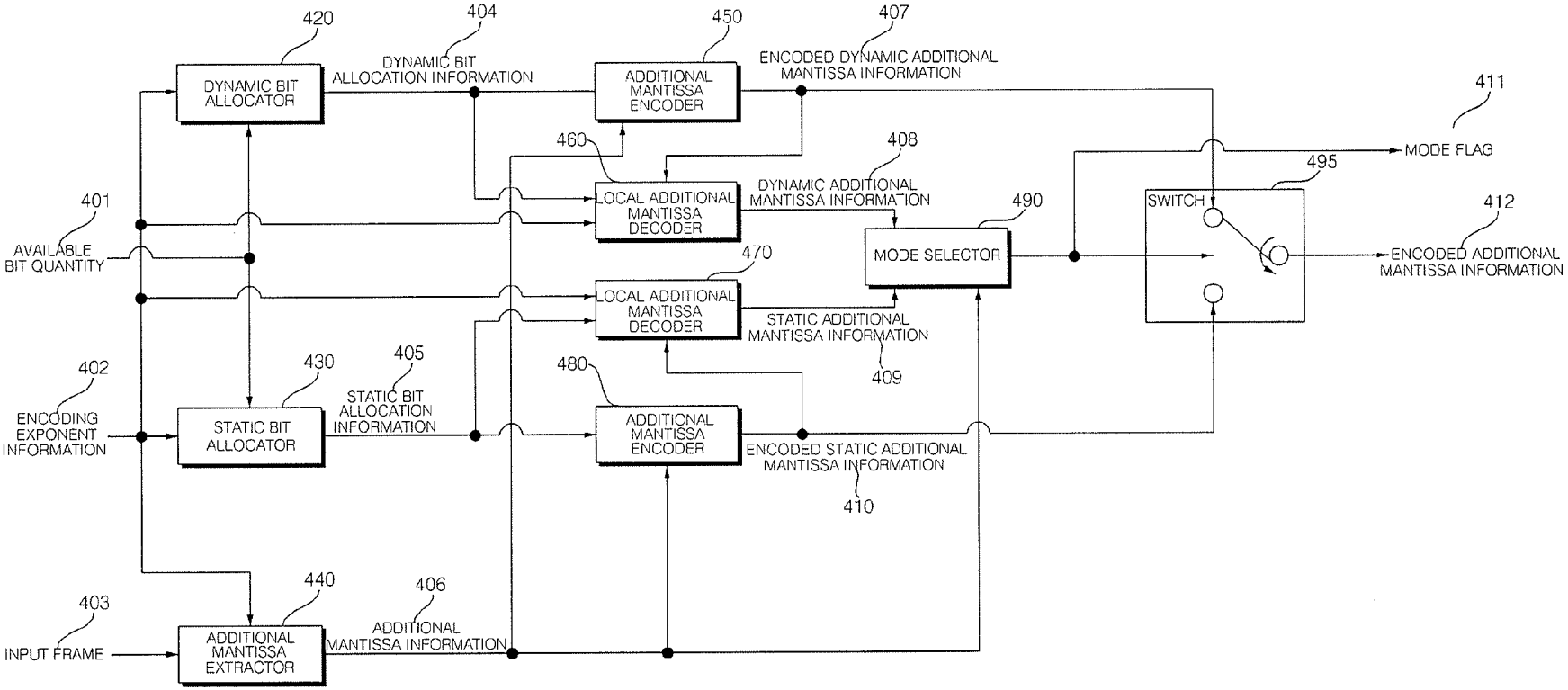
FIG. 4 illustrates a block diagram of the enhancement-layer encoder shown in FIG. 1.

FIG. 4 illustrates a block diagram of the enhancement-layer encoder 115. Referring to FIG. 4, the enhancement-layer encoder 115 may serve as a dual-mode enhancement-layer encoder.

The enhancement-layer encoder 115 may include a dynamic bit allocator 420, a static bit allocator 430, an additional mantissa extractor 440, additional mantissa encoders 450 and 480, local additional mantissa decoders 460 and 470, a mode selector 490 and a switch 495.

The dynamic bit allocator 420 may calculate dynamic bit allocation information 404 using encoding exponent information 402 provided by the G.711 encoder 110 and available number of bits per frame 401, as prescribed in ITU-T Rec. G.711.1, "Wideband embedded extension for G.711 pulse code modulation".

Since the quantization error of a G.711 codec varies according to the magnitude of an input signal, the dynamic bit allocator 420 may dynamically allocate a number of bits to additional mantissa information of each sample in consideration of the magnitude of an input signal.

For example, if the transmission bitrate of an enhancement layer is 16 Kbps and the length of an input frame 403 is 5 ms, the total number of bits available in the enhancement layer except for those used by a G.711 codec may be 80 bits. Of a total of 80 available bits, zero to three bits may be allocated to additional mantissa information of each sample in consideration of exponent information of each sample in the input frame 403.

It will be described later in further detail how to dynamically allocate a number of bits to additional mantissa information of each sample in the input frame 403 in consideration of the magnitude of the input frame 403 with reference to FIGS. 5A and 5B.

The static bit allocator 430 may calculate static bit allocation information 405, which specifies the number of bits of each sample, by dividing the available bit quantity 401 by the number of samples in the input frame 403. The static bit allocation information 405 may be calculated as indicated by Equation (2):

$$\text{bit_alloc}[i] = \frac{B}{L},\ i = 0, 1, 2, \ldots (L-1) \tag{2}$$

where bit_alloc[i] indicates the static bit allocation information 405 of an i-th sample of the input frame 403, B indicates the available bit quantity 401, and L indicates the number of samples in the input frame 403.

For example, if the transmission bitrate of an enhancement layer is 16 Kbps and the length of the input frame 403 is 5 ms, the total number of bits available in the enhancement layer except for those used by a G.711 codec may be 80 bits. Of a total of 80 available bits, two bits may be equally allocated for additional mantissa information of each sample in the input frame 403 if the number of samples in the input frame is 40 samples.

The additional mantissa extractor 440 may extract additional mantissa information 406 from each sample in the input frame 403 using the encoding exponent information of each sample 402.

The additional mantissa encoder 450 may generate encoded dynamic additional mantissa information 407 by encoding the additional mantissa information 406 using the dynamic bit allocation information 404. Likewise, the additional mantissa encoder 480 may generate encoded static additional mantissa information 410 by encoding the additional mantissa information 406 using the static bit allocation information 405.

The local additional mantissa decoders 460 and 470 are additional mantissa decoders used in the enhancement-layer encoder 115. The local additional mantissa decoder 460 may restore dynamic additional mantissa information 408 by decoding the encoded dynamic additional mantissa information 407 using the dynamic bit allocation information 404 and the encoding exponent information 402. Likewise, the local additional mantissa decoder 470 may restore static additional mantissa information 409 by decoding the encoded static additional mantissa information 410 using the static bit allocation information 405 and the encoding exponent information 402.

The mode selector 490 may calculate quantization error energy (hereinafter referred to as dynamic quantization error energy) for a dynamic bit allocation mode using the dynamic additional mantissa information 408 and the additional mantissa information 406, and may calculate quantization error energy (hereinafter referred to as static quantization error energy) for a static bit allocation mode using the static additional mantissa information 409 and the additional mantissa information 406. Thereafter, the mode selector 490 may compare the dynamic quantization error energy and the static quantization error energy, may choose whichever of the dynamic quantization error energy and the static quantization error energy is lower than the other, may choose a bit allocation mode corresponding to the chosen quantization error energy, may set a mode flag 411 in the chosen bit allocation mode, and output the mode flag 411.

Since the dynamic bit allocation mode and the static bit allocation mode are both available, one bit may be used to encode the mode flag 411.

It will hereinafter be described in detail how to calculate dynamic quantization error energy and static quantization error energy with reference to Table 1.

Table 1 shows encoding results obtained by performing enhancement-layer encoding on frames each having five samples using a static bit allocation method and a dynamic bit allocation method and using a total of ten available bits. More specifically, in the static bit allocation method, a total of ten bits were equally distributed to all the five samples in a frame. On the other hand, in the dynamic bit allocation method, the number of bits allocated to each of the five samples of each frame is determined according to the G.711.1 recommendation.

TABLE 1

| | G.711 | | G.711 Quantization | Static Bit Allocation Number of Bits Allocated Restored | Dynamic Bit Allocation Number of Bits Allocated Restored |
|---|---|---|---|---|---|
| Input Sample | Exponent | Mantissa | Error | Quantization Error | Quantization Error |
| 0000 0111 1000 0001 | 011 (=3) | 1110 | 00 0001 (=1) | 2 Bits<br>00 0000 (=0) | 3 Bits<br>00 0000 (=0) |
| 0000 0101 1000 0010 | 011 (=3) | 0110 | 00 0010 (=2) | 2 Bits<br>00 0000 (=0) | 3 Bits<br>00 0000 (=0) |
| 0000 0010 1101 1111 | 010 (=2) | 0110 | 1 1111 (=31) | 2 Bits<br>1 1000 (=24) | 2 Bits<br>1 1000 (=24) |
| 0000 0010 1010 1111 | 010 (=2) | 0101 | 0 1111 (=15) | 2 Bits<br>0 1000 (=8) | 2 Bits<br>0 1000 (=8) |
| 0000 0001 0101 1001 | 001 (=1) | 0101 | 1001 (=9) | 2 Bits<br>1000 (=8) | 0 Bits<br>0000 (=0) |

Referring to Table 1, the parenthesized numeric values are decimal numbers, and the other numeric values are binary numbers. G.711 quantization error is quantization error that may be generated during a legacy G.711 encoding operation, and may correspond to the additional mantissa information 406 shown in FIG. 4. Restored quantization error is quantization error obtained by encoding the quantization error of each sample using a number of bits allocated either by the dynamic bit allocation method or by the static bit allocation method and restoring the encoded quantization error. For example, if an input sample is '0000 0111 1000 0001' and is encoded by a legacy G.711 encoder 110, the exponent and mantissa of the encoded input sample may be '011' and '1110', respectively, and a G.711 quantization error of '00 0001' may be generated.

In this case, if the static bit allocation method is used for the input sample, the encoded static bit allocation information 405 provided by the static bit allocator 430 may be two bits for the sample, the encoded static additional mantissa information 410 provided by the local additional mantissa encoder 480 may be '00', and the static additional mantissa information 409 provided by the local additional mantissa decoder 470 may be '00 0000'.

On the other hand, if the dynamic bit allocation method is used for the input sample, the encoded dynamic bit allocation information 404 provided by the dynamic bit allocator 420 may be three bits for the sample, the encoded dynamic additional mantissa information 407 provided by the local additional mantissa encoder 450 may be '000', and the dynamic additional mantissa information 408 provided by the local additional mantissa decoder 460 may be '00 0000'.

Static quantization error energy $E_{static}$ and dynamic quantization error energy $E_{dynamic}$ of the input sample may be calculated as indicated by Equations (3):

$$E_{static}=(1-0)^2+(2-0)^2+(31-24)^2+(15-8)^2+(9-8)^2=104$$

$$E_{dynamic}=(1-0)^2+(2-0)^2+(31-24)^2+(15-8)^2+(9-0)^2=184 \quad (3)$$

In short, quantization error for some input samples may be higher when using the dynamic bit allocation method than when using the static bit allocation method.

Therefore, when dynamic quantization error is higher than static quantization error for a given frame, the mode selector 490 may generate and output a static mode flag 411 indicating the static bit allocation mode. The static mode flag 411 may be encoded as '0 '. On the other hand, a dynamic mode flag 411 may be encoded as '1'.

The switch 495 may selectively output one of the encoded dynamic additional mantissa information 407 and the encoded static additional mantissa information 410 according to a mode flag 411 provided by the mode selector 490.

Therefore, the enhancement-layer encoder 115 may output an enhancement-layer bitstream including the encoded additional mantissa information 412 and a mode flag 411.

The additional mantissa extractor 440 may extract the additional mantissa information 406 from the encoding mantissa information 402 for each sample of an input frame 403.

In case that the maximum allowable number of bits per sample is 3, a pseudo source code of the additional mantissa extractor 440 may be indicated as follows:

```
for (i = 0; i < L; i++)          /* For all samples in frame */
{
    ext_bits[i] = exp[i] + 3;
    ext_mantissa[i] = x[i] & (2^ext_bits[i] - 1);
}
```

where L indicates the number of samples of the input frame 403, exp[i] indicates encoding exponent information 402 of the i-th sample i of the input frame 403, ext_bits[i] indicates an number of additional mantissa bit for the i-th sample, x[i] indicates the i-th sample, ext_mantissa[i] indicates additional mantissa information 406 of the i-th sample, and 'x&y' indicates performing a bitwise AND operation on x and y. For example, if the i-th sample is "0000 0001 1010 1001" in binary representation and is encoded using the G.711 A-law algorithm, the exponent of the i-th sample may be 1, the mantissa of the i-th sample may be 1010, and additional mantissa information 406 of the i-th sample may be 1001.

The additional mantissa encoder 450 may generate bits indicating the encoded dynamic additional mantissa 407 information in consideration of a number of bits corresponding to the dynamic bit allocation information 404 from the additional mantissa information 406 of each sample in the input frame 403. Likewise, the additional mantissa encoder 480 may generate bits indicating the encoded static additional mantissa 410 information in consideration of a number of bits corresponding to the static bit allocation information 405 from the additional mantissa information 406 of each sample in the input frame 403.

A pseudo source code of each of the additional mantissa encoders 450 or 480 may be indicated as follows:

```
for (i = 0; i < L; i++)          /* For all samples in frame */
{
    tx_bits_enh[i] = ext_mantissa[i] >> (ext_bits[i] - bit_alloc[i]);
}
```

where bit_alloc[i] indicates the number of bits allocated to the i-th sample of the input frame 403, tx_bits_enh[i] indicates additional mantissa information 407 or 410 to be transmitted of the i-th sample of the input frame 403, and 'x>>y' indicates bit-shifting x to the right by y bits. For example, if the additional mantissa information 406 of the i-th sample is 1001 and the allocated number of bits for the sample bit_alloc[i] is 3, additional mantissa information 406 of the i-th sample may be 100.

The local additional mantissa decoder 460 may restore the dynamic additional mantissa information 408 from the encoded dynamic additional mantissa information 407 using the dynamic bit allocation information 404 and the encoding exponent information 402. Likewise, the local additional mantissa decoder 470 may restore the static additional mantissa information 409 from the encoded static additional mantissa information 410 using the static bit allocation information 405 and the encoding exponent information 402.

A pseudo source code of each of the local additional mantissa decoders 460 and 470 may be indicated as follows:

```
for (i = 0; i < L; i++)          /* For all samples in frame */
{
    ld_ext_mantissa[i] = tx_bits_enh[i] << (exp[i] + 3 - bit_alloc[i]);
}
```

where exp[i] indicates encoding exponent information 402 of the i-th sample in the input frame 403, bit_alloc[i] indicates the number of bits allocated to the i-th sample, tx_bits_enh[i] indicates encoded dynamic or static additional mantissa information 407 or 410 of the i-th sample, and ld_ext_mantissa[i] indicates restored dynamic or static additional mantissa information 408 or 409 of the i-th sample. That is, the local additional mantissa decoders 460 and 470 may fill the encoded dynamic or static additional mantissa information 407 or 410 of the i-th sample with a number of zero bits corresponding to the difference between a maximum number of mantissa bits that can be added, determined by the exponent of the i-th sample, and the number of bits allocated to the i-th sample.

FIGS. 5A and 5B illustrate exemplary diagrams of an exponent map used in the dynamic bit allocator 420.

Referring to the exponent map shown in FIG. 5A, exponent indexes of additional mantissa information obtained from exponent information 402 for each sample in an input frame may be set as rows, and sample indexes in the input frame may be set as columns. For example, if the input frame consists of 40 samples and maximum number of bits for additional mantissa information is 3 bits, an exponent map for the input frame may be realized as a 10-by-40 matrix.

More specifically, the exponent indexes of a sample may be proportional to the magnitude of the samples and may be arranged sequentially. That is, the exponent indexes of a sample may be calculated by sequentially increasing by 1 from its exponent information. For example, if a bit sequence of exponent information of a sample is '000' (0 in decimal), the exponent indexes of the sample may become 0 (=exponent information+0), 1 (=exponent information+1), and 2 (=exponent information+2). If the exponent information of a sample is 7 (bit sequence: 111), the exponent indexes of the sample may become 7 (=exponent information+0), 8 (=exponent information+1), and 9 (=exponent information+2). Therefore, exponent indexes for additional mantissa information may range from 0 to 9.

Each element in the exponent map may be initialized to a value of −1. For all samples in the input frame, the sample index is stored in elements pointed by row index of exponent indices and column index of sample index. That is, (exponent index, sample index)=sample index. For example, if exponent information of the second sample in the input frame is "011" (3 in decimal), the exponent indexes of the second sample may be 3, 4 and 5. Thus, (3,4)=2, (4,4)=2, and (5,4)=2. Then, all the other row elements corresponding to the second sample index may be maintained the initial value of −1.

Once the exponent indexes for all the samples in the input frame are calculated in the above-mentioned manner, the sample indexes may be stored in rows corresponding to the exponent indexes of each sample in the input frame, thereby completing an exponent map. A bit allocation table which means an additional number of bits allocated to each samples in the input frame may be generated using the exponent map.

Referring to the exponent map, one bit may be respectively allocated to each sample with a highest exponent index (9 in the above embodiments), and then one bit may be allocated to each samples with a value obtained by subtracting 1 from the highest exponent index value of 9, i.e., the second highest exponent index value of 8. This operation is repeatedly performed until the total number of bits allocated to each samples in the input frame reaches to the total number of bits available in the input frame. The generation of a bit allocation table will be described later in further detail with reference to FIGS. 6 and 7.

Referring to the exponent map shown in FIG. 5B, exponent indexes of additional mantissa information obtained from exponent information 402 of each samples in an input frame may be set as rows, and sequence indexes which are the number of the same exponent index for each sample in the frame may be set as columns. For example, supposing that the input frame consists of 40 samples and maximum number of bits for additional mantissa information is 3 bits, all the 40 samples in the frame can have the same exponent indexes in the extreme case. Thus, the number of row in the exponent map may be 40 (ranging from row 0 to row 39), and the resulting exponent map may be realized as a 10-by-40 matrix.

It will hereinafter be described how to generate an exponent map for an n-th sample.

The exponent indexes for additional mantissa information of the n-th sample may be determined based on the exponent information of the n-th sample. That is, the exponent indexes of the n-th sample=exponent information +j (j=0, 1, 2 for maximum number of bits for additional mantissa information of 3 bits).

Once all of three exponent indexes for the n-th sample are determined, the sample index of the n-th sample may be respectively stored in element of exponent map having the respective exponent index as row index and the numbers of samples with the respective exponent index which is counted from the 0-th stage to the (n−1)-th stage as column index.

That is, (an exponent index, the number of samples with the exponent index in the previous stages)=the sample index of the n-th sample. Then, the numbers of samples with the exponent indexes of the n-th sample may increase by 1 respectively.

For example, if exponent information of the 0-th sample of the input frame is "110" in binary, the exponent indexes of the 0-th sample may be 6, 7 and 8. Because all the numbers of samples with each exponent index are initialized to 0s, (6,0)=0, (7,0)=0, and (8,0)=0. Thereafter, if exponent information of the 1-st sample of the input frame is "100" in binary, the exponent indexes of the 1-st sample may be 4, 5 and 6. Thus, (4,0)=1, (5,0)=1, and (6,1)=1. More specifically, (6,1)=1 because there is already a sample in the 0-th column allocated to an exponent index of 6 at the previous stage. After completing the 0-th and 1-st stage, the numbers of samples allocated to exponent indexes of 4, 5, 6, 7, and 8 may be 1, 1, 2, 1, and 1, respectively.

In this manner, once the generation of an exponent map for all the samples of the input frame is completed, it is possible to identify the number of samples corresponding to each exponent index and sample indexes in the exponent map.

Figure 6:
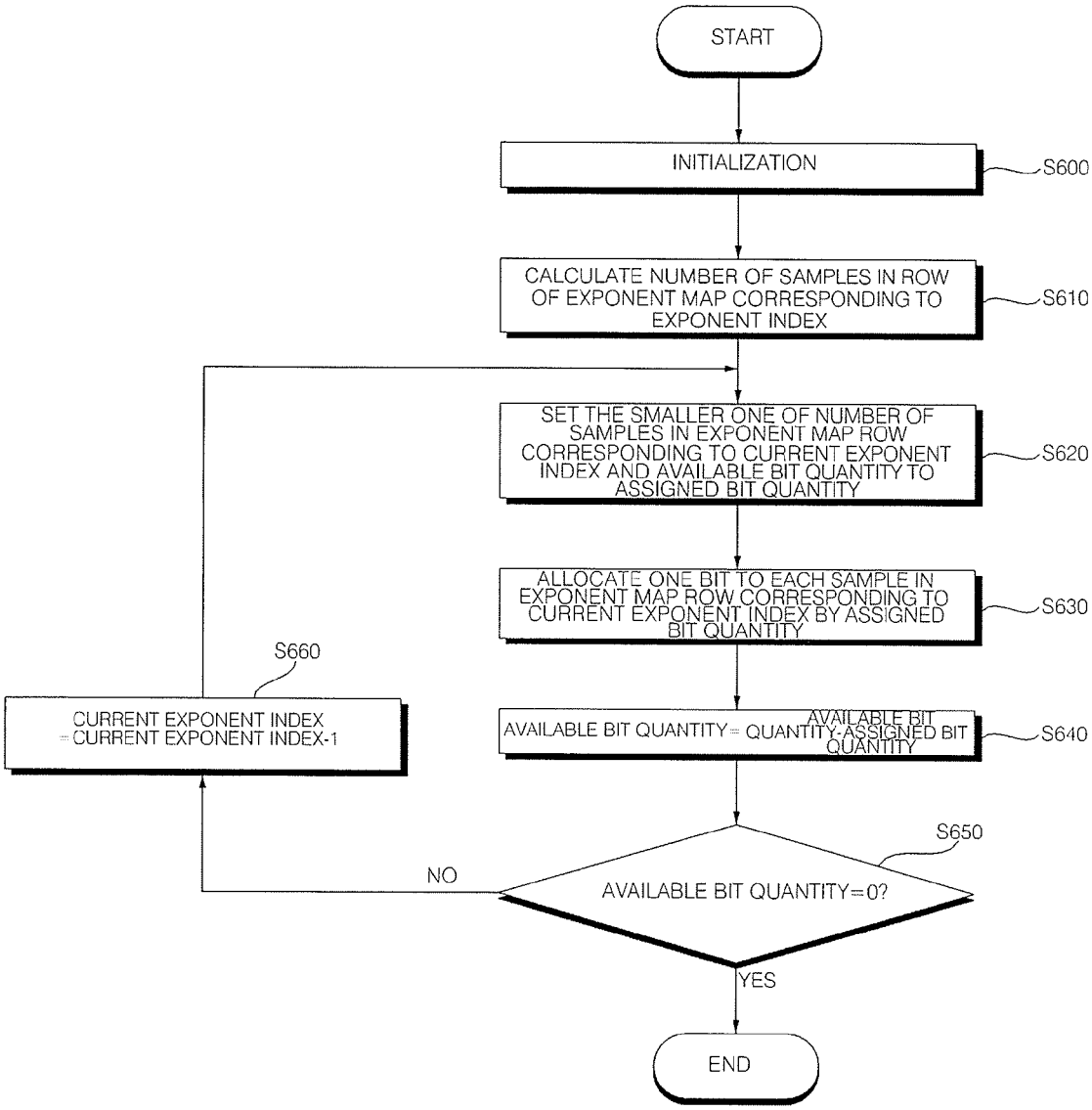
FIG. 6 illustrates a flowchart of a method of generating a bit allocation table for use in the dynamic bit allocator shown in FIG. 4.

FIG. 6 illustrates a flowchart of a method for generating a bit allocation table using the dynamic bit allocator 420. Referring to FIG. 6, if the maximum of additional number of bits for each sample is 3 and the available bit quantity 401 for a frame is 80, the dynamic bit allocator 420 may generate dynamic bit allocation information 404, which is zero to three bits for each sample based on exponent information of each sample in the frame.

More specifically, the dynamic bit allocator 420 may initialize all elements in a bit allocation table to 0s, may set the available bit quantity 401 to 80 bits, and may set current exponent index to maximum of exponent index (S600).

Thereafter, the dynamic bit allocator 420 may calculate the number of samples in a row of an exponent map corresponding to the current exponent index (S610). For example, referring to FIG. 5A, there are two samples corresponding to an exponent index of 8: samples are indexed from 0 to 39.

Thereafter, the dynamic bit allocator 420 may set an assigned bit quantity to the smaller one of the number of samples with the current exponent index and the available bit quantity in the current stage (S620) and may sequentially allocate one bit to each sample in row corresponding to the current exponent index (S630) until the assigned bit quantity is exhausted.

Thereafter, the dynamic bit allocator 420 may set a value obtained by subtracting the assigned bit quantity from the available bit quantity as an updated available bit quantity for the next stage (S640).

Thereafter, if the updated available bit quantity is zero (S650), the dynamic bit allocation procedure ends. On the other hand, if the updated available bit quantity is not zero (S650), the dynamic bit allocator 420 may set a value obtained by subtracting one from the current exponent index as a new exponent index (S660), and the dynamic bit allocation procedure iterates operations from S620 to S650.

Figure 7:
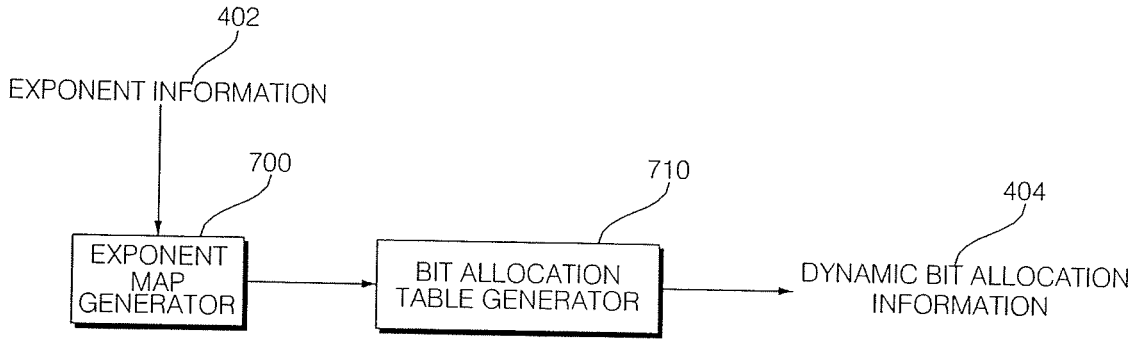
FIG. 7 illustrates a block diagram of the dynamic bit allocator shown in FIG. 4.

FIG. 7 illustrates a brief block diagram of the dynamic bit allocator 420. Referring to FIG. 7, the dynamic bit allocator 420 may include an exponent map generator 700 and a bit allocation table generator 710.

The exponent map generator 700 may calculate exponent indexes of additional mantissa information for each sample in a frame based on exponent information of each sample, and may thus generate an exponent map. The exponent information of each sample in a frame may be acquired from the G.711 encoder 110 shown in FIG. 1. The exponent map generated by the exponent map generator 700 has already been described above with reference to FIGS. 5A and 5B, and thus, a detailed description thereof will be omitted.

The bit allocation table generator 710 may search for samples with the exponent index from the maximum to the minimum sequentially referring to the exponent map generated by the exponent map generator 700, and may allocate one bit to each of the searched samples. In this manner, the bit allocation table generator 710 may generate a bit allocation table containing the number of bits allocated to each sample for encoding the additional mantissa information, i.e., the dynamic bit allocation information 404. The generation of a bit allocation table has already been described with reference to FIG. 6, and thus, a detailed description thereof will be omitted.

Referring to FIG. 4, the additional mantissa encoder 450 may receive a bit allocation table containing the dynamic bit allocation information 404 from the bit allocation table generator 710, and may output the dynamically encoded additional mantissa information 407 using the bit allocation table.

For example, the additional mantissa encoder 450 may output the most significant bits (MSBs) of the additional mantissa information 406 corresponding to the dynamic bit allocation information 404 (i.e., the number of bits allocated to each sample), as indicated by the following equation: [additional mantissa information 406]/2^[the number of bits for the additional mantissa information 406—the dynamic bit allocation information 404].

Alternatively, the dynamic bit allocator 420 may dynamically determine the bit quantity of the additional mantissa information 440, i.e., the dynamic bit allocation information 440, based on the significance of the additional mantissa information 440 determined by the exponent information. The significance of the additional mantissa information may minimize quantization error for each frame. Although the exponent (i.e., quantization level) of a sample is relatively high, the quantization error of the sample may be low. In this case, the significance of the sample may be decreased so that only a few bits can be allocated to the sample.

Figure 8:
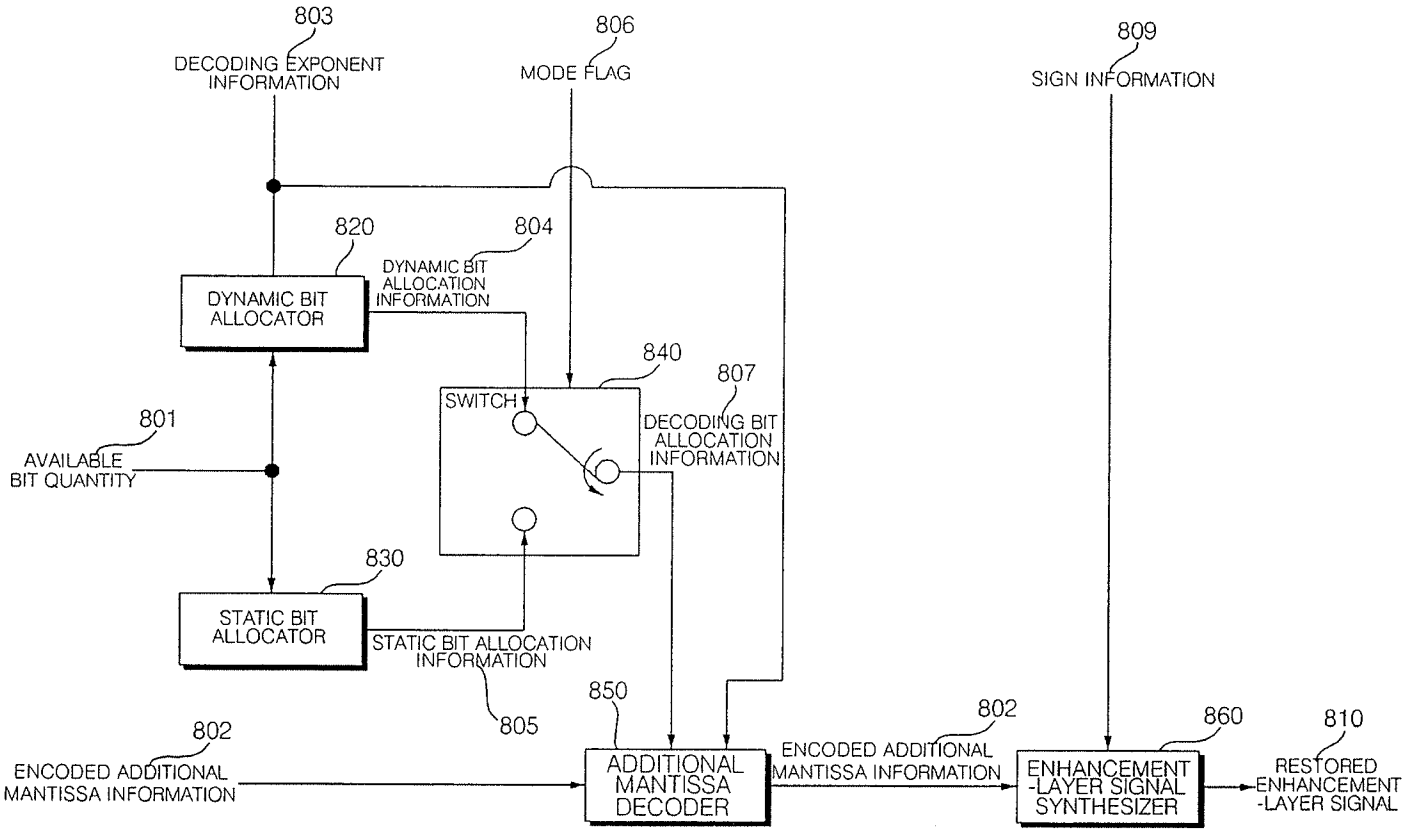
FIG. 8 illustrates a block diagram of an enhancement-layer decoder shown in FIG. 1.

FIG. 8 illustrates a block diagram of the enhancement-layer decoder 165. Referring to FIG. 8, the enhancement-layer decoder 165 may include a dynamic bit allocator 820, a static bit allocator 830, a switch 840, an additional mantissa decoder 850 and an enhancement-layer signal synthesizer 860.

The dynamic bit allocator 820 may calculate dynamic bit allocation information 804 using decoding exponent information 803 obtained from the G.711 decoder 160 and available bit quantity information 801decoder. The dynamic bit allocator 820, like the dynamic bit allocator 420 shown in FIG. 4, may include an exponent map generator (not shown) and a bit allocation table generator (not shown). The dynamic bit allocator 820 is almost the same as the dynamic bit allocator 420, and thus, a detailed description of the dynamic bit allocator 820 will be omitted.

The static bit allocator 830 may calculate the number of bits of each sample, i.e., static bit allocation information 805, by dividing the available bit quantity 801 by the number of samples.

The dynamic and static bit allocators 820 and 830 may calculate bit allocation information by using the same method as that used by the dynamic and static bit allocators 420 and 430 of the enhancement-layer encoder 115.

The switch 840 may output whichever of the dynamic bit allocation information 804 and the static bit allocation information 805 is chosen according to a received mode flag 806 as decoding bit allocation information 807.

The additional mantissa decoder 850 may restore additional mantissa information 808 for each sample using received encoded additional mantissa information 802, the decoding bit allocation information provided by the switch 840 and the decoding exponent information 803.

The enhancement-layer signal synthesizer 860 may restore an enhancement-layer signal 810 using additional mantissa information 808 and sign information 809 provided by the G.711 decoder 160.

The additional mantissa decoder 850 may restore the additional mantissa information 808 by extracting a number of bits corresponding to the decoding bit allocation information 807 from the encoded additional mantissa information 802.

A pseudo source code of the additional mantissa decoder 850 may be indicated as follows:

```
for (i = 0; i < L; i++)          /* For all samples in frame */
{
    ext__mantissa[i] = rx__bits__enh[i] << (exp[i] + 3 − bit__alloc[i]);
}
```

where rx_bits_enh[i] indicates encoded additional mantissa information 802 of an i-th sample. That is, the additional mantissa decoder 850 may fill the encoded additional mantissa information 802 of the i-th sample with a number of zero bits corresponding to the difference between a maximum number of mantissa bits and the number of bits allocated to the i-th sample.

A pseudo source code of the enhancement-layer signal synthesizer 860 may be indicated as follows:

```
for (i = 0; i < L; i++)          /* For all samples in frame */
{
    if (sign[i] == negative sign )
        sig__enh[i] = −sig__enh[i];
}
```

where sign[i] indicates sign information 809 for the i-th sample provided by the G.711 decoder 160. That is, if the sign information 809 represents a negative sign, the enhancement-layer signal synthesizer 860 may multiply the restored additional mantissa information 808 by (−1) and may output the result of the multiplication. On the other hand, if the signal information 809 represents a positive sign, the enhancement-layer signal synthesizer 860 may output the restored additional mantissa information 808 as it is.

The present invention can be realized as computer-readable code written on a computer-readable recording medium. The computer-readable recording medium may be any type of recording device in which data is stored in a computer-readable manner. Examples of the computer-readable recording medium include a ROM, a RAM, a CD-ROM, a magnetic tape, a floppy disc, an optical data storage, and a carrier wave (e.g., data transmission through the Internet). The computer-readable recording medium can be distributed over a plurality of computer systems connected to a network so that computer-readable code is written thereto and executed therefrom in a decentralized manner. Functional programs, code, and code segments needed for realizing the present invention can be easily construed by one of ordinary skill in the art.

According to the present invention, it is possible to considerably reduce quantization error and improve sound quality by allowing a G.711 encoder to encode an input audio signal and allowing an enhancement-layer encoder to encode additional mantissa information using whichever of a static bit allocation method and a dynamic bit allocation method can produce less quantization error than the other method.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An encoding apparatus comprising:

a G.711 encoder which generates a G.711 bitstream by encoding an input audio signal;

an enhancement-layer encoder which chooses one of a static bit allocation method and a dynamic bit allocation method that is configured to produce less quantization error based on the input audio signal and the G.711 coded bitstream, and outputs an enhancement-layer bitstream including encoded additional mantissa information obtained by using the chosen bit allocation method; and a multiplexer which multiplexes the G.711 bitstream and the enhancement-layer bitstream.

2. The encoding apparatus of claim 1, wherein the enhancement-layer encoder comprises a dynamic bit allocator which calculates dynamic bit allocation information in which the number of bits of additional mantissa information for each sample in an input frame varies depending on an exponent information of each sample, a static bit allocator which calculates static bit allocation information in which the number of bits of additional mantissa information for each sample in the input frame is uniformly allocated, and a mode selector which outputs a mode flag for choosing whichever of the static bit allocation method and the dynamic bit allocation method is configured to produce less quantization error using the dynamic bit allocation information and the static bit allocation information.

3. The encoding apparatus of claim 2, further comprising a switch which chooses one of encoded dynamic additional mantissa information and encoded static additional mantissa information with reference to the mode flag and outputs the chosen encoded additional mantissa information and, an additional mantissa extractor which extracts additional mantissa information of each sample in the input frame using encoding exponent information of each sample, wherein the mode selector outputs the mode flag based on the additional mantissa information extracted by the additional mantissa extractor.

4. The encoding apparatus of claim 2, further comprising:

a dynamic additional mantissa encoder which generates encoded dynamic additional mantissa information by encoding additional mantissa information using the dynamic bit allocation information; and a static additional mantissa encoder which generates encoded static additional mantissa information by encoding the additional mantissa information using the static bit allocation information.

5. The encoding apparatus of claim 4, further comprising:

a dynamic local additional mantissa decoder which restores dynamic additional mantissa information by decoding the encoded dynamic additional mantissa information with reference to encoding mantissa information and the dynamic bit allocation information of each sample in the input frame, and outputs the restored dynamic additional mantissa information to the mode selector; and a static local additional mantissa decoder which restores static additional mantissa information by decoding the encoded static additional mantissa information with reference to the encoding mantissa information and the static bit allocation information of each sample in the input frame, and outputs the restored static additional mantissa information to the mode selector.

6. The encoding apparatus of claim 2, wherein the dynamic bit allocator comprises an exponent map generator which generates an exponent map in which exponent indexes of additional mantissa information obtained from exponent information of each sample in the input frame and sample indexes respectively corresponding to the samples of the input frame are arranged, and a bit allocation table generator which allocates a number of bits to each sample in the input frame in decreasing order of the exponent indexes and generates a bit allocation table indicating the number of bits allocated to each sample in the input frame.

7. A decoding apparatus comprising:

a demultiplexer which demultiplexes an input bitstream into a G.711 bitstream and an enhancement-layer bitstream, the enhancement layer bitstream being encoded by an enhancement-layer encoder which chooses one of a static bit allocation method and a dynamic bit allocation method that is configured to produce less quantization error based on the input audio signal and the G.711 coded bitstream, and outputs an enhancement-layer bitstream including encoded additional mantissa information obtained by using the chosen bit allocation method;

a G.711 decoder which generates a decoded G.711 signal by decoding the G.711 bitstream;

an enhancement-layer decoder which generates a decoded enhancement-layer signal by decoding the enhancement-layer bitstream using a method selected by a mode flag also included in the enhancement-layer bitstream, and wherein the mode flag chooses the at least one of the static bit allocation method and the dynamic bit allocation method; and a signal synthesizer which synthesizes the decoded G.711 signal and the decoded enhancement-layer signal.

8. The decoding apparatus of claim 7, wherein the enhancement-layer decoder comprises a dynamic bit allocator which calculates dynamic bit allocation information in which the number of bits of additional mantissa information for each samples in an input frame varies depending on an exponent information of each sample, a static bit allocator which calculates static bit allocation information in which the number of bits of additional mantissa information for each sample in the input frame is uniformly allocated, and a switch which outputs one of the dynamic bit allocation information and the static bit allocation information according to a mode flag and outputs the chosen bit allocation information as decoding bit allocation information.

9. The decoding apparatus of claim 8, further comprising an additional mantissa decoder which decodes the additional mantissa information of each sample in the input frame using the decoding exponent information of each sample and the decoding bit allocation information and, an enhancement-layer signal synthesizer which generates a restored enhancement-layer signal by using the decoded additional mantissa information from the additional mantissa decoder and sign information from the G.711 decoder.

10. The decoding apparatus of claim 8, wherein the dynamic bit allocator comprises an exponent map generator which generates an exponent map in which exponent indexes of additional mantissa information obtained from exponent information of each sample in the input frame and sample indexes respectively corresponding to the samples of the input frame are arranged, and a bit allocation table generator which allocates a number of bits to each sample in the input frame in decreasing order of the exponent indexes and generates a bit allocation table indicating the number of bits allocated to each sample in the input frame.

11. The decoding apparatus of claim 10, wherein the bit allocation table generator generates the bit allocation table by repeatedly allocating one bit to each sample in the input frame in decreasing order of the exponent indexes until the total number of bits available in the input frame is exhausted.

12. Bit allocation method for enhancement-layer, comprising the steps of:

providing a processor and a memory, the memory having stored thereon:

inputting enhancement-layer encoding signal;

encoding the input signal by a static bit allocation method;

encoding the input audio signal by a dynamic bit allocation method;

comparing the result of encoding the input signal by a static bit allocation method and the result of encoding the input audio signal by a dynamic bit allocation method; and choosing at least one of a static bit allocation method and a dynamic bit allocation method by the result of comparison.

13. The method of claim 12, wherein, in the step of comparing the result of encoding the input signal by a static bit allocation method and the result of encoding the input audio signal by a dynamic bit allocation method, the decoding the both results; and comparing the decoding signals and input signals.

14. The bit allocation method for enhancement-layer utilizing a decoding apparatus comprising:

a demultiplexer which demultiplexes by a processor an input bitstream into a G.711 bitstream and an enhancement-layer bitstream, the enhancement layer bitstream being encoded by an enhancement-layer encoder which chooses one of a static bit allocation method and a dynamic bit allocation method that is configured to produce less quantization error based on the input audio signal and the G.711 coded bitstream, and outputs an enhancement-layer bitstream including encoded additional mantissa information obtained by using the chosen bit allocation method;

a G.711 decoder which generates a decoded G.711 signal by decoding the G.711 bitstream;

an enhancement-layer decoder which generates a decoded enhancement-layer signal by decoding the enhancement-layer bitstream using a method selected by a mode flag also included in the enhancement-layer bitstream, and wherein the mode flag chooses the at least one of the static bit allocation method and the dynamic bit allocation method; and a signal synthesizer which synthesizes the decoded G.711 signal and the decoded enhancement-layer signal.

15. The decoding apparatus of claim 14, wherein the enhancement-layer decoder comprises a dynamic bit allocator which calculates dynamic bit allocation information in which the number of bits of additional mantissa information for each samples in an input frame varies depending on an exponent information of each sample, a static bit allocator which calculates static bit allocation information in which the number of bits of additional mantissa information for each sample in the input frame is uniformly allocated, and a switch which outputs one of the dynamic bit allocation information and the static bit allocation information according to a mode flag and outputs the chosen bit allocation information as decoding bit allocation information.

16. The decoding apparatus of claim 15, further comprising an additional mantissa decoder which decodes the additional mantissa information of each sample in the input frame using the decoding exponent information of each sample and the decoding bit allocation information.

17. The decoding apparatus of claim 16, further comprising an enhancement-layer signal synthesizer which generates a restored enhancement-layer signal by using the decoded additional mantissa information from the additional mantissa decoder and sign information from the G.711 decoder.

18. The decoding apparatus of claim 15, wherein the dynamic bit allocator comprises an exponent map generator which generates an exponent map in which exponent indexes of additional mantissa information obtained from exponent information of each sample in the input frame and sample indexes respectively corresponding to the samples of the input frame are arranged, and a bit allocation table generator which allocates a number of bits to each sample in the input frame in decreasing order of the exponent indexes and generates a bit allocation table indicating the number of bits allocated to each sample in the input frame.

19. The decoding apparatus of claim 18, wherein the bit allocation table generator generates the bit allocation table by repeatedly allocating one bit to each sample in the input frame in decreasing order of the exponent indexes until the total number of bits available in the input frame is exhausted.

20. The decoding apparatus of claim 14, further comprising an output buffer which stores a decoded signal provided by the signal synthesizer.

* * * * *